US006144937A

United States Patent [19]

Ali

[11] Patent Number: 6,144,937

[45] Date of Patent: Nov. 7, 2000

[54] NOISE SUPPRESSION OF SPEECH BY SIGNAL PROCESSING INCLUDING APPLYING A TRANSFORM TO TIME DOMAIN INPUT SEQUENCES OF DIGITAL SIGNALS REPRESENTING AUDIO INFORMATION

[75] Inventor: Murtaza Ali, Plano, Tex.

[73] Assignee: Texas Instruments Incorporated, Dallas, Tex.

[21] Appl. No.: 09/116,130

[22] Filed: Jul. 15, 1998

Related U.S. Application Data

[60] Provisional application No. 60/053,539, Jul. 23, 1997.

[51] Int. Cl.[7] ..... G10C 21/02

[52] U.S. Cl. ..... 704/233; 704/226

[58] Field of Search ..... 704/233, 200, 704/205, 203, 201, 226, 227, 228

[56] References Cited

U.S. PATENT DOCUMENTS

| | | | |
|---|---|---|---|
| 5,682,463 | 10/1997 | Allen et al. | 704/230 |
| 5,684,920 | 11/1997 | Iwakami et al. | 704/203 |
| 5,758,316 | 5/1998 | Tsutsui | 704/206 |
| 5,805,739 | 9/1998 | Malvar et al. | 382/253 |
| 5,832,424 | 11/1998 | Oikawa et al. | 704/230 |
| 5,848,391 | 12/1998 | Bosi et al. | 704/500 |
| 5,946,038 | 8/1999 | Kalker | 348/397 |

OTHER PUBLICATIONS

A. Akbari Azirani, R. Le Bouquin Jeannes, G. Faucon, "Optimizing Speech Enhancement by Exploiting Masking Properties of the Human Ear," *IEEE*, pp. 800–803, 1995.

Nathalie Virag, "Speech Enhancement Based on Masking Properties of the Auditory System," *IEEE*, pp. 796–799, 1995.

Jin Yang, "Frequency Domain Noise Suppression Approaches in Mobile Telephone Systems," *IEEE*, pp. 363–366, 1993.

Henrique S. Malvar, "Efficient Signal Coding with Hierarchical Lapped Transforms," *IEEE*, pp. 1519–1522, 1990.

Steven F. Boll, "Suppression of Acoustic Noise in Speech Using Spectral Substraction," *IEEE*, pp. 113–120, 1979.

M. Berouti, R. Schwartz, J. Makhoul, "Enhancement of Speech Corrupted by Acoustic Noise," *IEEE*, pp. 69–73, 1979.

Henrique S. Malvar, "Lapped Transforms for Efficient Transform/Subband Coding," *IEEE*, pp. 969–978, 1990.

Chang D. Yoo, "Selective All–Pole Modeling of Degraded Speech Using M–Band Decomposition," *IEEE*, pp. 641–644, 1996.

Henrique S. Malvar, "Extended Lapped Transforms: Properties, Applications, and Fast Algorithms," *IEEE*, pp. 2703–2714, 1992.

*Primary Examiner*—Richemond Dorvil

*Attorney, Agent, or Firm*—Robert L. Troike; Frederick J. Telecky, Jr.

[57] ABSTRACT

A communications device, such as a cellular telephone handset (10), and a method of operating the same to suppress noise in audio information such as speech, is presented. The handset (10) includes a digital signal processor (DSP) (30) having program memory (31) for controlling the DSP (30) to apply a hierarchical lapped transform to the input digital sequence. The hierarchical lapped transform decomposes the input sequence into coefficients representative of plurality of sub-bands corresponding to critical bands of the human ear. Each coefficient is modified by a noise suppression filter operator, based upon a ratio of an estimate of the noise power to an estimate of the signal power in the corresponding sub-band; clamping of changes in the noise power estimate over time, and use of a decaying signal envelope estimate, eliminate distortion in the processed signal. Musical noise is eliminated by using a minimum gain value in each sub-band. Inverse transformation of the modified coefficients provides the filtered time-domain output signal. Improved noise suppression is provided, in a manner that may be readily and robustly performed by fixed-point digital signal processors.

22 Claims, 4 Drawing Sheets

NOISE SUPPRESSION OF SPEECH BY SIGNAL PROCESSING INCLUDING APPLYING A TRANSFORM TO TIME DOMAIN INPUT SEQUENCES OF DIGITAL SIGNALS REPRESENTING AUDIO INFORMATION

CROSS-REFERENCE TO RELATED APPLICATIONS

This application claims priority under 35 USC § 119(e)(1) of provisional application number 60/053,539, filed Jul. 23, 1997.

STATEMENT REGARDING FEDERALLY SPONSORED RESEARCH OR DEVELOPMENT

Not applicable.

BACKGROUND OF THE INVENTION

This invention is in the field of signal processing, and is more specifically directed to noise suppression in the telecommunication of human speech.

Recent advances in telecommunications technology have resulted in widespread use of telephonic equipment in relatively noisy environments. For example, portable cellular telephones are now often used in automobiles, out of doors, or in other environments having significant background acoustic noise. The level of acoustic noise is exacerbated in hands-free cellular telephones, particularly when used in automobiles. High levels of noise are not limited to wireless telephones, as speakerphones are now commonly used in many homes and offices. As a result, techniques for the suppression of noise (or, conversely, the enhancement of signal) are of particular importance in the field of telecommunications.

So-called "active" noise suppression techniques have been developed for use in some telephonic applications. Active noise suppression relies on the presence of multiple microphones, such as may be present in advanced teleconferencing systems; analysis and combination of the signals received by the multiple microphones is then used to identify and suppress noise components in the received signal. However, cost considerations have resulted in the widespread prevalence of single microphone telephonic equipment, particularly in the wireless telephone market, and for which active noise suppression techniques are not an option.

"Passive" noise suppression techniques refer to the class of approaches in which the amplitude of noise in a transmitted signal is reduced through processing of a signal from an individual source. A major class of passive noise suppression techniques is referred to in the art as spectral subtraction. Spectral subtraction, in general, considers the transmitted noisy signal as the sum of the desired speech with a noise component. The spectrum of the noise component is estimated, generally during time windows that are determined to be "non-speech". The estimated noise spectrum is then subtracted, in the frequency domain, from the transmitted noisy signal to yield the remaining desired speech signal.

A typical spectral subtraction routine, as implemented in conventional digital wireless telephone equipment, is based on the Fast Fourier Transform (FFT), as is readily performable by digital signal processors (DSPs) such as those available from Texas Instruments Incorporated. Examples of spectral subtraction approaches are described in Boll, "Suppression of Acoustic Noise in Speech Using Spectral Subtraction", *IEEE Trans. on Acoustics, Speech, and Signal Processing*, Vol. ASSP-27, No. 2 (April, 1979), pp. 113–120, and in Berouti, et al., "Enhancement of Speech Corrupted by Acoustic Noise", *Proceedings of the IEEE Conference on Acoustics, Speech, and Signal Processing* (IEEE, April 1979), pp. 208–211. In this conventional approach, an FFT is performed to transform the noisy speech signal into the frequency domain. Spectral subtraction utilizes a frequency-domain filter operator $G(\omega)$ that is derived from an estimate $P_n(\omega)$ of the power spectrum of the noise in the signal and the power spectrum $P_x(\omega)$ of the noisy speech signal $X(\omega)$. Typically, the estimate of the noise power spectrum is based on the assumption that noise is constant over both speech and non-speech time intervals of the signal; the noise power spectrum estimate $P_n(\omega)$ is thus simply set equal to the power spectrum $P_x(\omega)$ of the input signal $X(\omega)$ during non-speech intervals. The conventional frequency-domain filter operator $G(\omega)$ is derived as:

$$G(\omega) = \left(1 - \frac{P_n(\omega)}{P_x(\omega)}\right)^{\frac{1}{2}}$$

This frequency-domain filter operator $G(\omega)$ is applied to the noisy speech spectrum $X(\omega)$ to produce an estimate $S(\omega)$ of the spectrum of the speech component as follows:

$$S(\omega)=G(\omega)X(\omega)$$

Inverse FFT of the estimate $S(\omega)$ will then render a filtered time-domain speech signal.

The quality of a noise suppression technique depends, of course, upon its ability to eliminate acoustic noise without distorting the speech signal, and without itself introducing noise into the signal. While spectral subtraction does reduce the level of noise in the signal, other undesirable effects have been observed. One such effect is the introduction of "musical noise" into the signal which appears during non-speech intervals in the signal. Musical noise is due to measurement error in the estimate of the noise power spectrum, which causes the filter operator $G(\omega)$ to randomly vary across frequency and over time, producing fluctuating tonal noise that some observers have found to be more annoying than the original background acoustic noise. In addition, inaccuracies in distinguishing between speech and non-speech intervals, as necessary in estimating the noise spectrum, have been observed to clip the desired speech signal (when falsely detecting a non-speech interval) and to be insensitive to changes in the background noise (in effect, falsely detecting a speech interval).

By way of further background, division of noisy speech signals into multiple sub-bands for noise suppression processing is known in the art, for example as described in Yang, "Frequency Domain Noise Suppression Approaches in Mobile Telephone Systems", *Proceedings of the ICASSP-93*, Vol. II (1993), pp. 363–366, relative to spectral subtraction techniques. Sub-band division of the noisy speech signal is also known in connection with the noise suppression technique of all-pole based Weiner filtering, as described in Yoo, "Selective All-Pole Modeling of Degraded Speech Using M-Band Decomposition", *Proceedings of the ICASSP-96* (1996), pp. 641–644. Each of these approaches divide the input signal into substantially equally spaced frequency bands.

By way of further background, another type of noise suppression utilizes the simultaneous masking effect of the human ear. It has been observed that the human ear ignores, or at least tolerates, additive noise so long as its amplitude remains below a masking threshold in each of multiple critical frequency bands within the human ear; as is well known in the art, a critical band is a band of frequencies that are equally perceived by the human ear. Virag, "Speech Enhancement Based on Masking Properties of the Auditory System", *Proceedings of the ICASSP*-95 (1995), pp. 796–799, describes a technique in which masking thresholds are defined for each critical band, and are used in optimizing spectral subtraction to account for the extent to which noise is masked during speech intervals. Azirani, et al., "Optimizing Speech Enhancement by Exploiting Masking Properties of the Human Ear", *Proceedings of the ICASSP*-95 (1995), pp. 800–803, use sub-band masking thresholds to determine, for each time interval, whether noise is masked. Optimal estimators are then derived for the masked and unmasked states to reduce both musical noise and speech distortion in noisy speech signal. Each of the Virag and Azirani et al. approaches utilizes an FFT "front-end", with the critical band analysis used in calculation of gain factors only.

By way of still further background, signal processing transforms known as the extended lapped transform (ELT) and hierarchical lapped transform (HLT) are known in the art. These transforms are described as providing an intermediate solution between the efficient technique of transform coding which is not particularly suitable for the implementation of bandpass filter banks, and the perfect reconstruction provided by sub-band coding, at an expense of computational complexity. Examples of the HLT and ELT signal processing techniques are described in H. S. Malvar, "Lapped Transforms for Efficient transform/Sub-band Coding," *IEEE Transactions on Acoustics, Speech, and Signal Processing*, Vol. 38, No. 6 (June 1990) pp. 969–978; H. S. Malvar, "Extended Lapped Transforms: Properties, Applications, and Fast Algorithms," *IEEE Transactions on Signal Processing*, Vol. 40, No. 11 (November 1992) pp. 2703–2714; and H. S. Malvar, "Efficient Signal Coding with Hierarchical Lapped Transforms," *Proceedings of the IEEE International Conference on Acoustics, Speech and, Signal Processing* (ICASSP-90) (April 1990) pp. 1519–1522.

BRIEF SUMMARY OF THE INVENTION

It is an object of the present invention to provide an apparatus and method for suppressing noise in telecommunication.

It is a further object of the present invention to provide such an apparatus and method which is particularly useful in suppressing noise in communicated speech signals.

It is a further object of the present invention to provide such an apparatus and method which is adapted to the critical bands of the human ear.

It is a further object of the present invention to provide such an apparatus and method that may be efficiently performed by low cost computing equipment of relatively modest performance and memory capacity.

It is a further object of the present invention to provide such an apparatus and method in which the dynamic range is much reduced from that in conventional signal processing transforms.

It is a further object of the present invention to provide such an apparatus and method in which substantially no musical noise is present in the resultant speech signal output.

Other objects and advantages of the present invention will be apparent to those of ordinary skill in the art having reference to the following specification together with its drawings.

The present invention may be implemented into a telephonic apparatus, such as a wireless telephone, and a method of operating the same, to suppress acoustic noise in an input speech signal that includes additive acoustic noise. A hierarchical lapped transform is applied to the sampled incoming signal to divide the signal into frequency sub-bands of non-uniform bandwidth, corresponding to critical bands of the human ear. For each sub-band, the transform coefficients are modified by the application of a gain filter operator derived from a ratio of an estimate of the noise power in the sub-band to an estimate of the noisy signal power in the same sub-band calculated using the larger of the input signal amplitude or a decayed amplitude from a prior time interval. Inverse application of the hierarchical lapped transform to the modified coefficients returns the filtered signal. The present invention is preferably performed by a conventional digital signal processor (DSP), over a reasonably small number of sample points so that delay is minimized.

DETAILED DESCRIPTION OF THE INVENTION

As will become apparent from the following description, the present invention may be implemented into modern communications systems of many types in which human audible signals, such as voice and other audio, are communicated. In particular, the present invention is particularly beneficial in relatively low-cost systems, particularly those using single microphones for which active noise suppression techniques, such as noise-cancellation, are not available. Examples of systems in which the present invention is contemplated to be particularly beneficial include cellular telephone handsets, speakerphones, small audio recording devices, and the like.

Figure 1:
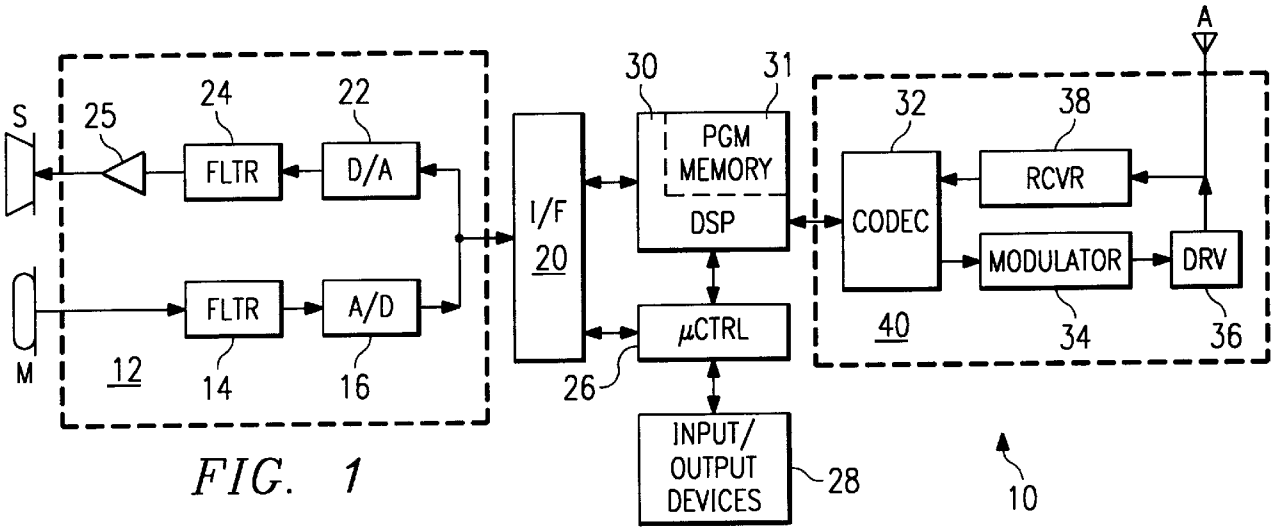
FIG. 1 is an electrical diagram, in block form, of a telecommunications system according to the preferred embodiment of the present invention.

Referring now to FIG. 1, an example of a communications system constructed according to the preferred embodiment of the present invention will now be described in detail. Specifically, FIG. 1 illustrates the construction of digital cellular telephone handset 10 constructed according to the preferred embodiment of the invention; of course, as noted above, many other types of communications systems may also benefit from the present invention. While, the preferred embodiment of the present invention is particularly directed to processing information prior to transmission, it will be readily understood by those of ordinary skill in the art that the present invention may alternatively be applied in receiving devices, to suppress noise in received voice and audio signals.

Handset 10 includes microphone M for receiving audio input, and speaker S for outputting audible output, in the conventional manner. Microphone M and speaker S are connected to audio interface 12 which, in this example, converts received signals into digital form and vice versa, in the manner of a conventional voice coder/decoder ("codec"). In this example, audio input received at microphone M is applied to filter 14, the output of which is applied to the input of analog-to-digital converter (ADC) 16. On the output side, digital signals are received at an input of digital-to-analog converter (DAC) 22; the converted analog signals are then applied to filter 24, the output of which is applied to amplifier 25 for output at speaker S.

The output of ADC 16 and the input of DAC 22 in audio interface 12 are in communication with digital interface 20. Digital interface 20 is connected to microcontroller 26 and to digital signal processor (DSP) 30, by way of separate buses in the example of FIG. 1.

Microcontroller 26 controls the general operation of handset 10. In this example, microcontroller 26 is connected to input/output devices 28, which include devices such as a keypad or keyboard, a user display, and add-on cards such as a SIM card. Microcontroller 26 handles user communication through input/output devices 28, and manages other functions such as connection, radio resources, power source monitoring, and the like. In this regard, circuitry used in general operation of handset 10, such as voltage regulators, power sources, operational amplifiers, clock and timing circuitry, switches and the like are not illustrated in FIG. 1 for clarity; it is contemplated that those of ordinary skill in the art will readily understand the architecture of handset 10 from this description.

In handset 10 according to the preferred embodiment of the invention, DSP 30 is connected on one side to interface 20 for communication of signals to and from audio interface 12 (and thus microphone M and speaker S), and on another side to radio frequency (RF) circuitry 40, which transmits and receives radio signals via antenna A. DSP 30 is preferably a fixed point digital signal processor, for example the TMS320C54x DSP available from Texas Instruments Incorporated, programmed to process signals being communicated therethrough in the conventional manner, and also according to the preferred embodiment of the invention described hereinbelow. Conventional signal processing performed by DSP 30 may include speech coding and decoding, error correction, channel coding and decoding, equalization, demodulation, encryption, and other similar functions in handset 10. These operations are performed under the control of instructions that are preferably stored in program memory 31 of DSP 30, which may be read-only memory (ROM) of the mask-programmed or electrically-programmable type.

According to the preferred embodiment of the invention, a portion of program memory 31 in DSP 30 contains program instructions by way of which noise suppression is carried out upon the speech signals communicated from microphone M through audio interface 12, for transmission by RF circuitry 40 over antenna A to the telephone system and thus to the intended recipient. The detailed operation of DSP 30 according to these program instructions will be described in further detail hereinbelow.

RF circuitry 40, as noted above, bidirectionally communicates signals between antenna A and DSP 30. For transmission, RF circuitry 40 includes codec 32 which receives digital signals from DSP 30 that are representative of audio to be transmitted, and codes the digital signals into the appropriate form for application to modulator 34. Modulator 34, in combination with synthesizer circuitry (not shown), generates modulated signals corresponding to the coded digital audio signals; driver 36 amplifies the modulated signals and transmits the same via antenna A. Receipt of signals from antenna A is effected by receiver 38, which is a conventional RF receiver for receiving and demodulating received radio signals; the output of receiver 38 is connected to codec 32, which decodes the received signals into digital form, for application to DSP 30 and eventual communication, via audio interface 12, to speaker S.

Figure 2:
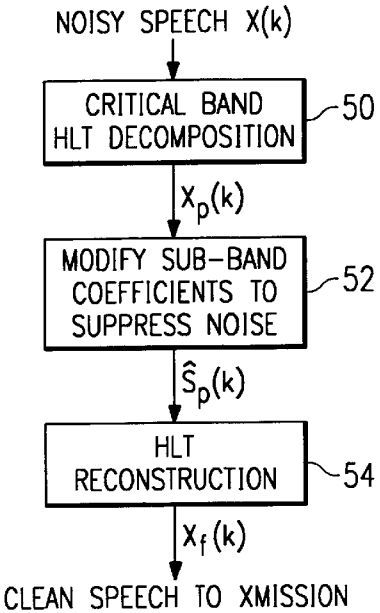
FIG. 2 is a flow diagram generally illustrating the operation of the system of FIG. 1 in suppressing noise according to the preferred embodiment of the present invention.

As noted above, DSP 30 is programmed to perform noise suppression upon received speech and audio input from microphone M. Referring now to FIG. 2, the sequence of operations performed by DSP 30 in suppressing noise in the input speech signal prior to transmission according to the preferred embodiment of the invention, will now be described.

As illustrated in FIG. 2, the noise suppression performed by DSP 30 in handset 10 begins, after the receipt of noisy speech from audio interface 12, with process 50 in which DSP 30 decomposes the received noisy speech. According to the preferred embodiment of the invention, decomposition process 50 is performed according to a hierarchical lapped transform (HLT) in which the sub-bands are selected to match the behavior of the human ear, as will now be described.

As is well known in the art, and as noted above, the human ear has been observed to respond in various critical frequency bands. Each critical band refers to a frequency band in which all frequencies are equally perceived by the ear. It has been observed that the width of the critical bands increases with frequency. For example, the lowest frequency critical bands have a width of on the order of 125 Hz, while some higher audible frequency critical bands have a bandwidth of on the order of 500 Hz. According to the preferred embodiment of the invention, the input noisy speech signal is decomposed, in process 50, into multiple sub-bands that roughly correspond to the critical bands of the human ear. Because of the varying widths of the critical bands with frequency, the decomposition of process 50 effectively corresponds to a non-uniform bandwidth bandpass filter bank.

Figure 3:
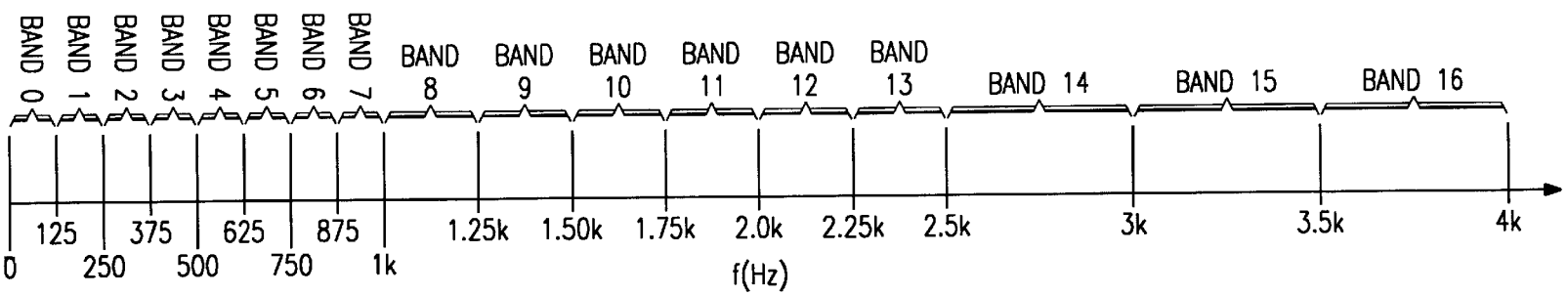
FIG. 3 is a diagram of the frequency sub-bands into which the input signal is decomposed according to the preferred embodiment of the invention.

FIG. 3 illustrates an exemplary set of critical frequency bands into which process 50 decomposes the input noisy speech signal. In this exemplary embodiment, the sampling frequency of the speech input is 8 kHz, which renders an overall signal bandwidth of 4 kHz, as is typical for digitally sampled telephony. According to the preferred embodiment of the invention, process 50 generates seventeen frequency bands of varying bandwidth, based on the 8 kHz sampled signal. The first eight bands (BAND 0 through BAND 7) are each 125 Hz in width, and range from 0 Hz to 1 kHz, with BAND 0 covering 0 Hz to 125 Hz, BAND 1 covering 125 Hz to 250 Hz, and so on. The next six frequency bands (BAND 8 through BAND 13) are each 250 Hz in width, and range from 1 kHz to 2.5 kHz, with BAND 8 covering 1 kHz to 1250 Hz, BAND 9 covering 1250 Hz to 1500 Hz, and so on. The upper three frequency bands, BAND 14 through BAND 16, are each 500 Hz in width; BAND 14 covers frequencies from 2.5 kHz to 3.0 kHz, BAND 15 covers frequencies from 3.0 kHz to 3.5 kHz, and BAND 16 covers frequencies from 3.5 kHz to 4.0 kHz. The frequency bands illustrated in FIG. 3 and described herein closely match the critical frequency bands of the human ear. In the preferred embodiment of the invention, sub-band filtering of the noisy input signal according to the band structure of FIG. 3 has been found to be beneficial in reducing noise and in providing high fidelity transmitted signals.

According to the preferred embodiment of the invention, process 50 is performed by DSP 30 performing an extended lapped transform (ELT) in a hierarchical manner, and is thus referred to as a hierarchical lapped transform (HLT). As described in H. S. Malvar, "Efficient Signal Coding with Hierarchical Lapped Transforms," *Proceedings of the IEEE International Conference on Acoustics, Speech and, Signal Processing* (ICASSP-90) (April 1990), pp 1519–1522, incorporated herein by this reference, hierarchical transforms in general, and HLTs specifically, provide filter banks for sub-band decomposition in a manner that permits definition of the sub-bands in a way that is most appropriate for the particular application. As described in this reference, and also in H. S. Malvar, "Lapped Transforms for Efficient transform/Sub-band Coding", *IEEE Transactions on Acoustics, Speech, and Signal Processing*, Vol. 38, No. 6 June 1990), pp. 969–978; H. S. Malvar, "Extended Lapped Transforms: Properties, Applications, and Fast Algorithms", *IEEE Transactions on Signal Processing*, Vol. 40, No. 11 (November 1992), pp. 2703–2714, also incorporated herein by this reference, lapped transforms have the important property that the basis functions are at least twice as long as the number of transform coefficients (i.e., block size). This longer basis size provides improved bandpass performance as compared with conventional discrete cosine transform (DCT) filters, which have basis functions equal in length to the block size, but with computational complexities that are comparable to DCT transforms, and thus far less complex than quadrature-mirror-filters and other long basis finite impulse response filters.

As described in the above-incorporated Malvar references, various types of lapped transforms are known in the art. According to the preferred embodiment of the invention, the extended lapped transform (ELT) described in Malvar, "Extended Lapped Transforms: Properties, Applications, and Fast Algorithms", *IEEE Transactions on Signal Processing*, Vol. 40, No. 11 (November 1992), pp. 2703–2714, is used in process 50. The ELT is a special class of lapped transforms, based upon cosine-modulated filter banks. The synthesis matrix P of the ELT is in the form:

$$f_k(n)=p_{nk}$$

for k=0, 1, . . . , M−1, and n=0, 1, . . . , NM−1, where M is the number of sub-bands, and N is the number of samples applied to the filter; the value $p_{nk}$ is the element in the nth row and kth column of matrix P, with $f_k$ representing the impulse response of the $k^{th}$ filter in the synthesis filter bank. The impulse responses of the corresponding analysis filters, represented as $h_k(n)$, are thus defined as:

$$h_k(n)=f_k(NM-1-n)$$

The lapped transform requirement of matrix P requires that it satisfy the orthogonal conditions of $$P'W^mP=\delta(m)I$$

where δ(m) is the unitary impulse, P' is the transpose of matrix P which serves as the analysis matrix, I is the identity matrix, and W is the one-block shift matrix defined as:

$$W \equiv \begin{pmatrix} 0 & I \\ 0 & 0 \end{pmatrix}$$

In the special case of the ELT, the synthesis matrix P is given by:

$$p_{nk} \equiv h(n)\sqrt{\frac{2}{M}}\cos\left[\omega_k\left(n+\frac{M+1}{2}\right)\right]$$

which is a cosine modulated filter bank with modulating frequencies $\omega_k$ given by:

$$\omega_k=\left(k+\frac{1}{2}\right)\frac{\pi}{M}$$

Fast algorithms for performing the ELT are described in Malvar, "Extended Lapped Transforms: Properties, Applications, and Fast Algorithms," *IEEE Transactions on Signal Processing*, Vol. 40, No. 11 (November 1992) pp. 2703–2714.

The ELT is particularly advantageous when used in the preferred embodiment of the present invention, for several reasons. Firstly, the ELT is an invertible transform, such that a paired transform and inverse transform sequence perfectly reconstructs the input signal. As such, only the effects of filtering or modification performed upon the transform coefficients (prior to inverse transform) will be reflected in the output signal. Secondly, the ELT is computationally very efficient, even when executed in a hierarchical fashion according to the preferred embodiment of the invention, with a complexity that is on the order of conventional DCTs. The lapping of the samples applied to the ELT reduces any boundary effects that otherwise can occur from the division of the input sample stream into processable blocks. Furthermore, it has also been observed that the dynamic range of the output of the ELT is much reduced from that of other transforms, such as FFTs. This reduced dynamic range results in improved accuracy in the transform results, such that noise suppression according to the preferred embodiment of the invention is more robust when performed by fixed point digital signal processors than are FFT and other conventional transforms.

Figure 4:
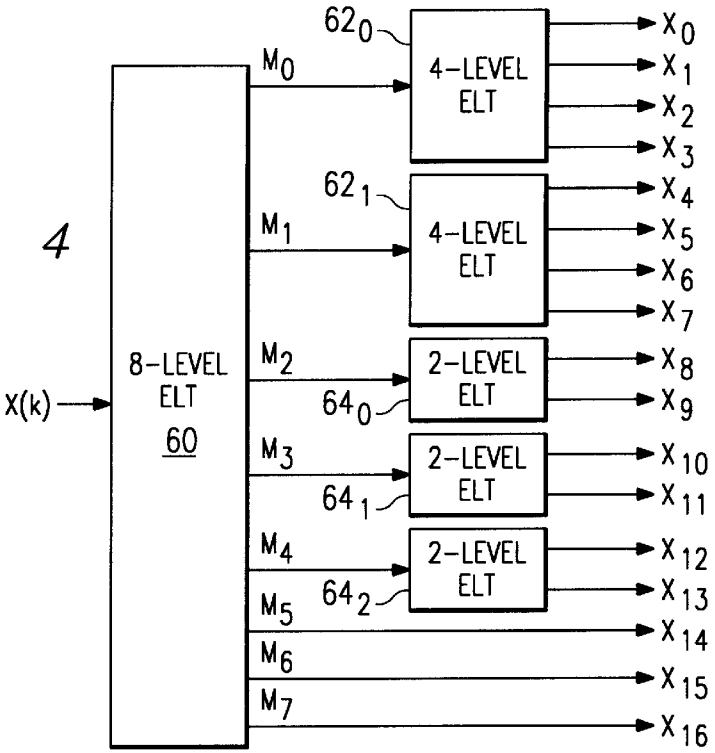
FIG. 4 is a block diagram illustrating the structure of the hierarchical lapped transform as applied to the input signal according to the preferred embodiment of the present invention.

Referring now to FIG. 4, the structure of the HLT performed in process 50 of the preferred embodiment of the invention will now be described in detail. Noisy input signal x(k) is a stream of sample values of the noisy input signal, sampled at 8 kHz as described above and thus representative of speech of frequency up to 4 kHz with additive noise. In this embodiment of the invention, input signal x(k) is first applied to an eight-level extended lapped transform (ELT) filter bank 60, which produces eight outputs corresponding to eight sub-bands. Eight-level ELT filter bank 60 performs a lapped transform, as defined above, upon the incoming sample values of noisy speech signal x(k), in combination with some previous values of the noisy speech signal that are retained therein.

A description of the construction and operation of ELT filter bank 60, and of all of the filter banks 62, 64 illustrated in FIG. 4, is provided in Malvar, "Extended Lapped Transforms: Properties, Applications, and Fast Algorithms," *IEEE Transactions on Signal Processing*, Vol. 40, No. 11

(November 1992) pp. 2703–2714, incorporated herein by this reference. As described therein, the extended lapped transform may be readily performed by a sequence of butterfly operations, followed by a Type IV discrete cosine transform (DCT), and thus using conventional digital signal processing circuitry. In the case of eight-level ELT filter bank 60, the ELT filter described in the Malvar paper is performed using M=8.

As known in the art, digital signal processing routines are typically performed upon a group of sampled values. For example, FFT and DFT transform routines are commonly performed upon groups of sample input values ranging from 32 to 256 values or greater; for example, an FFT performed upon a group of 256 sample input values is referred to as a 256-point FFT. Upon completion of the transform, the next group of sample input values is then processed.

Figure 5:
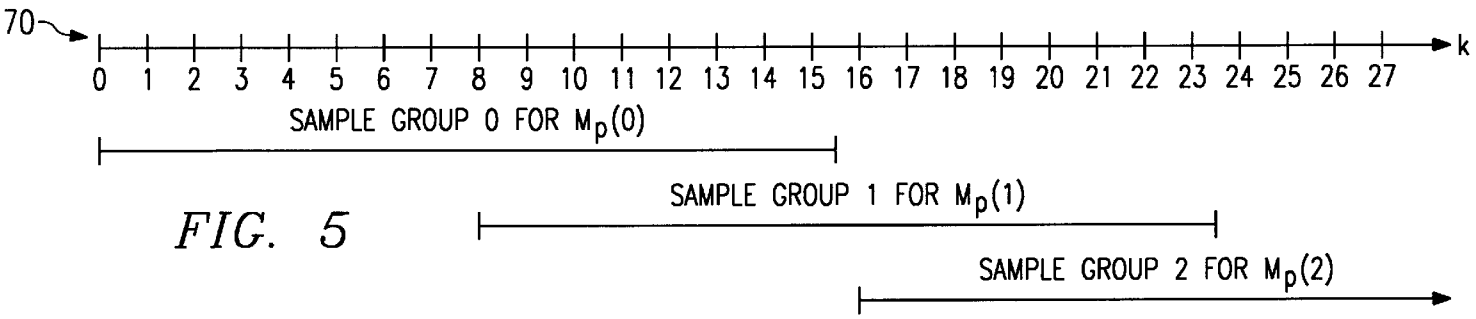
FIG. 5 is a time line illustrating the lapping of the time samples according to the preferred embodiment of the invention.

Referring now to FIG. 5, the selection and application of groups of sample input values x(k) to eight-level ELT filter bank 60 of FIG. 4 will now be described. As shown therein, time line 70 illustrates the relative position of a sequence of sample input values x(k) forward in time from k=0. Sample values x(0) through x(15) define a sixteen point group, from which a first set of sub-band coefficients $M_p(0)$ (p referring to the sub-band index, as will be described hereinbelow) are defined according to the preferred embodiment of the invention. A second set of sub-band coefficients $M_p(1)$ are defined from the sample input values x(8) through x(23); as such, a set of sub-band coefficients $M_p(i)$ are generated from each new set of eight sample values x(k), using eight previously received sample values x(k) that were used in generating the prior set of sub-band coefficients $M_p(i-1)$. As evident from FIG. 5, the sample input values used in generating the next set of sub-band coefficients overlap the previous group of sample input values by fifty percent in this example. This overlapping (from which the name "lapped transform" is derived) results from the basis function being twice as long as the number of coefficients resulting from the transform, and greatly reduces boundary effects in the resulting processed signal. Other lapping factors, other than the factor of two illustrated in FIG. 5, may alternatively be used in connection with the present invention.

Referring back to FIG. 4, each group of eight input noisy speech sample values x(k) are applied to eight-level ELT transform filter bank 60. In this example, eight-level ELT transform filter bank 60 generates a set of eight output coefficients $M_0$ through $M_7$ upon each operation. Considering the lapping of input sample values illustrated in FIG. 5, eight-level ELT transform filter bank 60 operates upon sixteen input sample values, eight of which are retained from the previous set of samples. Upon receipt of these input samples, eight-level ELT transform filter bank 60 performs the ELT as described above upon the received and retained input sample values, and generates eight output coefficients $M_0$ through $M_7$, corresponding to eight sub-bands of the 0–4 kHz frequency band, effectively bandpass filtering the input signal x(k) into eight 500 Hz bands.

As illustrated in FIG. 3, the higher frequency coefficients $M_5$ through $M_7$ are associated with the wider frequency bands (e.g., BAND 14 through BAND 16). In this embodiment of the invention, transform coefficient $X_{16}$ for the highest frequency band (BAND 16) corresponds to coefficient $M_7$, transform coefficient $X_{15}$ for frequency sub-band BAND 15 corresponds to coefficient $M_6$, and transform coefficient $X_{14}$ for frequency sub-band BAND 14 corresponds to coefficient $M_5$. Each operation of eight-level ELT transform filter bank 60 thus produces a transform coefficient value $X_p$ for each of sub-bands BAND 14 through BAND 16. As one transform coefficient value $X_p$ for p=14 through p=16 is generated from each set of eight new input sample values x(k), an effective downsampling by a factor of eight is performed for sub-bands BAND 14 through BAND 16. Transform coefficients $X_p$ are thus banded transform coefficients of the input noisy speech signal x(k).

The next three output coefficients $M_4$, $M_3$, and $M_2$ are applied, individually, to two-level ELT transform filter banks $\mathbf{64}_2$, $\mathbf{64}_1$, $\mathbf{64}_0$, respectively, for generation of coefficients $X_{13}$ through $X_8$, respectively. As noted above, each of frequency bands BAND 13 through BAND 8 has a bandwidth of 250 Hz. Two-level ELT transform filter banks 64 are similarly implemented by way of butterfly operations followed by a DCT Type IV operation, as described in the Malvar article incorporated hereinto by reference. However, two values of each of coefficients $M_4$, $M_3$, and $M_2$ are used by each of two-level ELT transform filter banks $\mathbf{64}_2$, $\mathbf{64}_1$, $\mathbf{64}_0$, respectively, to generate a single output coefficient $X_p$. As such, each of two-level ELT transform filter banks 64 perform one operation for every two operations of eight-level ELT transform filter bank 60. The output coefficients $X_8$, $X_9$ (both generated from coefficient $M_2$ by two-level ELT transform filter bank $\mathbf{64}_0$), $X_{10}$, $X_{11}$ (both generated from coefficient $M_3$ by two-level ELT transform filter bank $\mathbf{64}_1$), and $X_{12}$, $X_{13}$ (both generated from coefficient $M_4$ by two-level ELT transform filter bank $\mathbf{64}_2$) are each thus effectively downsampled from the input noisy speech sample stream x(k) by a factor of sixteen.

In a similar manner, but according to a more finely defined sub-band structure, four-level ELT transform filter banks $\mathbf{62}_0$, $\mathbf{62}_1$ generate the output coefficients $X_0$ through $X_7$ for 125 Hz bandwidth frequency bands BAND 0 through BAND 7, respectively. Four-level ELT transform filter banks 62 are similarly implemented by way of butterfly operations followed by a DCT Type IV operation, as described in the Malvar article incorporated hereinto by reference, but with M=4. In this example, four instances of coefficient $M_0$ are applied to four-level ELT transform filter bank $\mathbf{62}_0$ to generate output coefficients $X_0$ through $X_3$, and four instances of coefficient $M_1$ are applied to $\mathbf{62}_1$ to generate output coefficients $X_4$ through $X_7$. As such, each of four-level ELT transform filter banks 62 operate once for every four operations of eight-level ELT transform filter bank 60; output coefficients $X_0$ through $X_7$ are thus effectively downsampled from the input noisy speech sample stream x(k) by a factor of thirty-two.

As noted above, each operation of eight-level ELT transform filter bank 60 produces one value of each of transform coefficients $X_{14}$ through $X_{16}$, while two operations of eight-level ELT transform filter bank 60 are required to produce one value of each of transform coefficients $X_8$ through $X_{13}$, and four operations of eight-level ELT transform filter bank 60 are required to produce one value of each of transform coefficients $X_0$ through $X_7$. As a result, more values of transform coefficients $X_{14}$ through $X_{16}$ than of transform coefficients $X_0$ through $X_{13}$ are produced over time. This disparity in the number of transform coefficients X does not affect noise reduction and other subsequent processing, as such processing is performed on an individual sub-band basis, as will be described hereinbelow.

Figure 6:
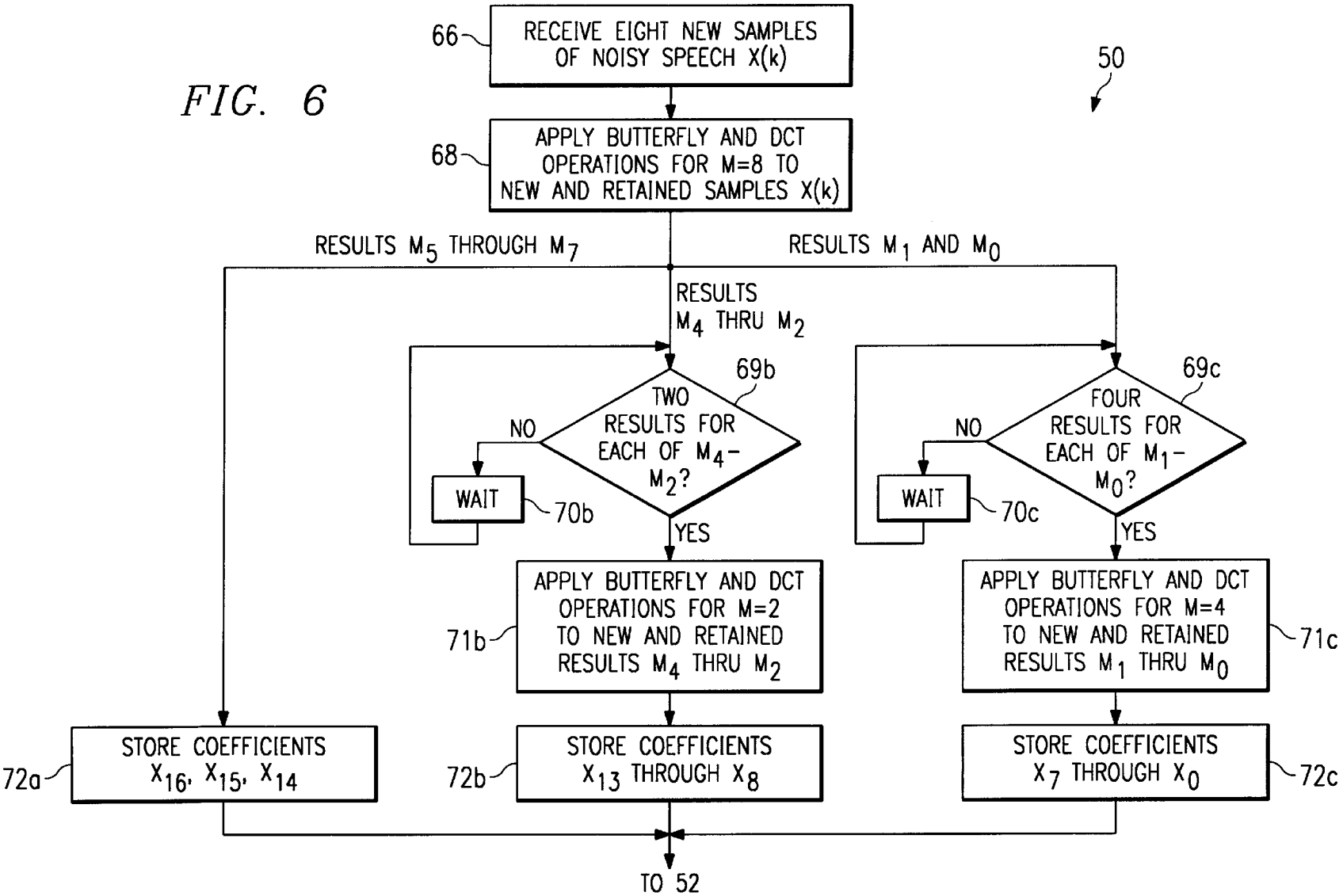
FIG. 6 is a flow diagram illustrating the operation of a digital signal processor in performing the hierarchical lapped transform according to the preferred embodiment of the present invention.

Referring now to FIG. 6, the operation of DSP 30 in performing process 50 according to the preferred embodiment of the present invention will now be described. The structure of filter banks 60, 62, 64 of FIG. 4 may be readily realized in digital signal processing algorithms by those in the art. As discussed above, a preferred example of this realization is described in Malvar, "Extended Lapped Transforms: Properties, Applications, and Fast Algorithms," *IEEE Transactions on Signal Processing*, Vol. 40, No. 11 (November 1992) pp. 2703–2714, incorporated hereinabove by reference. As described in the Malvar article, a fast ELT algorithm or filter bank may be implemented by a cascade of zero-delay orthogonal factors (i.e., butterfly matrices) and pure delays, followed by a discrete cosine transform (DCT) matrix factor. For purposes of computational efficiency, the butterfly matrices may be constructed so that diagonal entries may be ±1 in all of the butterfly matrices other than the final butterfly factor; indeed, in some cases, scaling may be implemented in the final DCT matrix factor. The matrix factors may be stored in program memory 31 of DSP 30, for efficiency of operation.

As described relative to FIG. 5, in this example of the preferred embodiment of the invention, eight-level ELT filter bank 60 operates upon receiving eight new input sample values, in combination with eight retained values corresponding to the immediately preceding eight sample values. As noted above, the downstream incorporation of four-level ELT filter banks 62 requires four operations of eight-level ELT filter bank 60 to produce a single value of transform coefficients $X_0$ through $X_7$, and as such the overall hierarchical arrangement of FIG. 4 may be referred to as a thirty-two point process. While more than thirty-two sample input values may be utilized if desired, at least thirty-two input points are necessary to provide a coefficient for each frequency sub-band according to the preferred embodiment of the invention.

Referring now to FIG. 6, process 50 begins with the receipt of a set of new sample input values for the noisy speech signal x(k), for example eight values, in process 66. As known in the art and as described in the Malvar article, process 66 is typically performed by receiving the sample input values in a time-ordered sequence, according to the sampling frequency.

In process 68, DSP 30 performs an eight-level extended lapped transform (ELT) upon the set of sample input values x(k) newly received in process 66, in combination with a set of sample input values retained from the previous operation. In this example, where eight new sample input values x(k) are received in process 66, and where lapping of 50% (lapping factor K=two) is utilized in the ELT, the previous eight sample input values are retained from the prior operation. For the first operation of process 68, the retained eight sample input values are simply set to zero. Process 68 preferably performs the eight-level ELT (M=8) using butterfly matrix operations and a Type IV DCT, as described in the Malvar article referenced above; process 68 thus corresponds to an operation of eight-level ELT filter bank 60 in the filter structure of FIG. 4. The result of process 68, as illustrated in FIG. 4, is eight intermediate transform coefficients $M_0$ through $M_7$, as described above.

As shown in FIG. 4, results $M_5$ through $M_7$ are the high-frequency coefficients generated by process 68. Considering that, according to the preferred embodiment of the present invention, the critical band analysis of noisy input signal x(k) has higher-frequency sub-bands with larger bandwidths, these results $M_5$, $M_6$, $M_7$ are not further decomposed, but are simply stored in the memory of DSP 30 as transform coefficients $X_{14}$, $X_{15}$, $X_{16}$ for the three highest frequency sub-bands BAND 14, BAND 15, BAND 16, respectively.

Results $M_2$ through $M_4$ from process 68 correspond to the middle frequency range of the critical bands of FIG. 3, from 1.0 to 2.5 kHz in this example. These results are to be further decomposed into 250 Hz bands. Referring back to FIG. 4, this decomposition is performed by two-level ELT filter banks $\mathbf{64}_0$ through $\mathbf{64}_2$; however, these two-level ELTs require two values of each result M for operation. Accordingly, as shown in FIG. 6, decision 69*b* first determines if two results for each of coefficients $M_2$ through $M_4$ are available; if not, wait process 70*b* is entered until processes 66, 68 are performed again upon a new set of sample inputs to produce an additional result value for each of coefficients $M_2$ through $M_4$. Once two values of results $M_2$ through $M_4$ are obtained, process 71*b* is then performed upon these values and upon two prior retained values (considering the K=2 overlapping of the ELT in this example) to separately decompose results $M_2$, $M_3$, $M_4$. Process 71*b* is performed by DSP 30 similarly as process 68, for example by using butterfly matrix operations and a Type IV DCT, with M=2, similarly as described hereinabove relative to process 68. Process 71*b* thus corresponds to two-level ELT filter banks $\mathbf{64}_0$ through $\mathbf{64}_2$ of FIG. 4. The results of process 71*b* correspond to transform coefficients $X_8$ through $X_{13}$ corresponding to sub-bands BAND 8 through BAND 13, respectively, which are then stored in memory of DSP 30 in process 72*b*.

The low-frequency results $M_0$ and $M_1$ are each to be further decomposed into four sub-bands to provide the low frequency critical band components. As noted above, such decomposition requires at least four values of each of results $M_0$ and $M_1$; decision 69*c* determines whether four such values are available and, if not, wait state 70*c* is entered until four passes of processes 66, 68 are complete. Process 71*c* is then performed individually to the four values of results $M_0$ and $M_1$, in combination with four retained prior results for each of these coefficients (again considering K=2 in the overlapping of the ELTs). Process 71*c* thus corresponds to the operation of four-level ELT filter banks $\mathbf{62}_0$, $\mathbf{62}_1$ of FIG. 4. As in processes 68 and 71*b*, the decomposition of process 71*c* may be performed using butterfly matrix operations and a Type IV DCT with M=4, considering that a four-band decomposition is to be performed. The results of process 71*c* produce coefficients $X_0$ through $X_7$ for sub-bands BAND 0 through BAND 7, respectively, which are stored by DSP 30 into its memory in process 72*c*.

As described in the Malvar article, the computational requirements of processes 68, 71*b*, 71*c*, are relatively modest. Even for the eight-sub-band filter bank implemented by process 68, as described in the article, only forty multiplications and fifty-six additions are required. As such, process 50 may be performed by digital signal processors of relatively modest complexity, without inserting significant delay in the processed signal.

The result of process 50, through use of a hierarchical bandpass filter structure as illustrated in FIG. 4 and according to a DSP-based algorithm as described above relative to FIG. 6, thus produces a set of output transform coefficients $X_0$ through $X_{16}$, respectively associated with the frequency sub-bands BAND 0 (0 to 125 Hz) through BAND 16 (3.5 kHz to 4.0 kHz). For purposes of the following description, these coefficients may be generally expressed as transform coefficients $X_p(k)$, where k refers to the kth group of input sample values, and where p refers to the pth sub-band of the decomposition.

Figure 7:
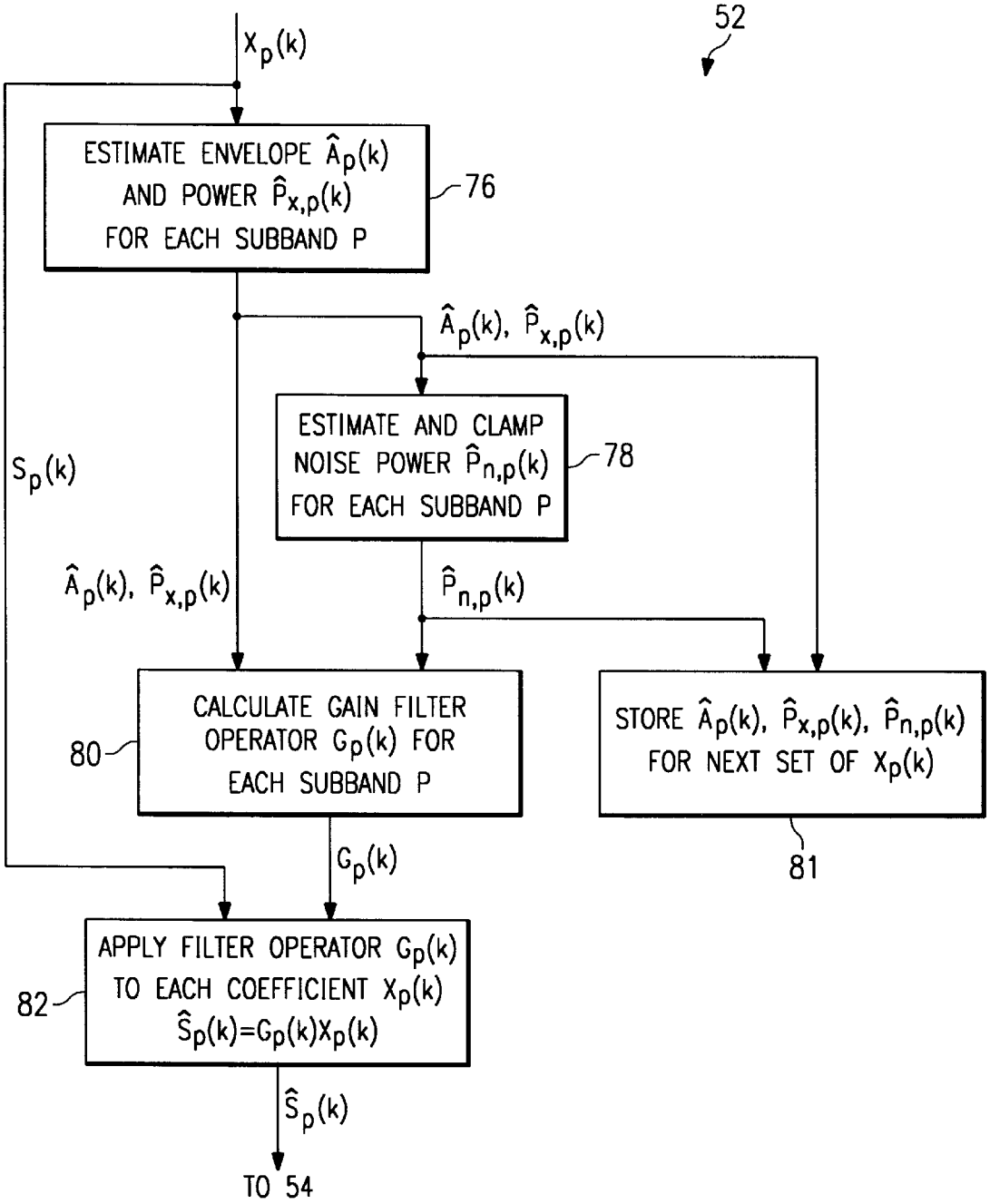
FIG. 7 is a flow diagram illustrating the modification of transform coefficients to suppress noise according to the preferred embodiment of the present invention.

Referring back to FIG. 2, process 52 is next performed to effect suppression of noise upon the transformed noisy input signal $X_p(k)$, as will now be described. Process 52 may be performed according to any desired conventional noise reduction technique, including conventional spectral subtraction as used in FFT noise reduction methods. According to the preferred embodiment of the invention, however, noise reduction process 52 is performed according to a smoothed subtraction method which has been observed to specifically reduce the presence of musical noise in the processed speech signal. According to this smoothed subtraction method, a gain filter operator in the transform domain is derived from estimates of the signal component and the noise component in each sub-band, where these estimates are derived in a manner so as to reduce the generation of musical noise, as described in copending U.S. application Ser. No. 08/426,746, filed Apr. 19, 1995 entitled "Speech Noise Suppression", commonly assigned herewith and incorporated herein by this reference. In effect, process 52 performs the following operation in each sub-band p:

$$\hat{S}_p(k)=G_p(k)X_p(k)$$

where $\hat{S}_p(k)$ is the modified coefficient $X_p(k)$ for the pth sub-band, representative of the speech component of the signal, and where $G_p(k)$ is the gain filter operator. Process 52 according to the preferred embodiment of the present invention will now be described in detail with reference to FIG. 7.

Process 52 according to this preferred embodiment of the invention begins with the estimation of the signal magnitude envelope represented by each coefficient $X_p(k)$ for each sub-band p, performed by DSP 30 in process 76. As noted hereinabove, the present invention considers the input noisy signal x(k) as the sum of a signal portion s(k) with additive noise n(k); accordingly, the present method considers each of the transform coefficients $X_p(k)$ as the sum of a signal component $S_p(k)$ with a noise component $N_p(k)$. According to the preferred embodiment of the present invention, process 76 generates an estimate $\hat{A}_p(k)$ of the envelope of the noisy speech signal transform coefficient $X_p(k)$ in a manner that is analogous to full-wave rectification of the signal with capacitor discharge; estimates of the power of the noisy speech input signal $X_p(k)$ and the noise component $N_p(k)$ will then be generated from this envelope estimate $\hat{A}_p(k)$. Generation of the envelope estimate $\hat{A}_p(k)$ is performed, for each sub-band p, using the most recent previous envelope estimate $\hat{A}_p(k-1)$ from the previous set of sample input values, as follows:

$$\hat{A}_p(k)=max(|X_p(k)|, \gamma\hat{A}_p(k-1))$$

where γ is a scalar factor corresponding to the desired rate of decay to be applied to the previous estimate $\hat{A}_p(k-1)$.

Fundamentally, noise suppression process 52 considers speech to dominate any high-amplitude sub-band coefficient, and considers noise to dominate any low-amplitude sub-band coefficient; in effect, only noise is considered to be present in non-speech time intervals, defined by intervals in which the signal is relatively weak. According to the preferred embodiment of the invention, therefore, the envelope estimate $\hat{A}_p(k)$ in each of the p sub-bands is set equal to the magnitude of coefficient $X_p(k)$ if this magnitude is greater than that of the most recent envelope estimate $\hat{A}_p(k-1)$ times the decay factor γ. Also in process 76, an initial power estimate $\hat{P}_{x,p}(k)$ is estimated, for example in a manner corresponding to a one-pole low pass filter, as follows:

$$\hat{P}_{x,p}(k)=(1.0-\beta)(\hat{A}_p(k))^2+\beta\hat{P}_{x,p}(k-1)$$

where β is a filter constant, as is well known in the art.

The envelope estimate $\hat{A}_p(k)$ is then applied by DSP 30 to process 78, in which the noise power estimate is determined, for each sub-band p, in similar fashion as described in the above-incorporated U.S. application Ser. No. 08/426,746. As described in this copending application, any signal that is always present (i.e., both in speech and non-speech intervals) is classified as noise. Process 78 thus begins with an initial noise power estimate $\hat{P}_{n,p}(k)$ for each sub-band p that is derived as follows:

$$\hat{P}_{n,p}(k)=(1.0-\beta)(\hat{A}_p(k))^2+\beta\hat{P}_{n,p}(k-1)$$

where $\hat{P}_{n,p}(k-1)$ is the most recent previous estimate of the noise power in the pth sub-band, and where β is the filter factor used in process 76. This initial noise power estimate $\hat{P}_{n,p}(k)$ is then modified by DSP 30 in process 78 so as to neither increase nor decrease by more than a certain amount from iteration to iteration. For example, according to the preferred embodiment of the invention, noise power estimate $\hat{P}_{n,p}(k)$ is clamped in process 78 so as not to increase at a rate faster than 3 dB per second nor decrease at a rate faster than 12 dB per second.

The clamping applied by process 78 takes into account the nature of speech as consisting of relatively brief segments of high magnitude signal over time, separated by pauses in which acoustic noise dominates (of a relatively low magnitude). It is therefore desirable that the noise power estimate $\hat{P}_{n,p}(k)$ not be rapidly modified by a speech segment; this is accomplished by the relatively low maximum increase rate of noise power estimate $\hat{P}_{n,p}(k)$ (e.g., 3 dB/second). Conversely, it is desirable that the noise power estimate $\hat{P}_{n,p}(k)$ rapidly decrease with a decrease in signal, such as at the end of a speech interval; this is permitted by the relatively high maximum decrease rate of noise power estimate $\hat{P}_{n,p}(k)$ (e.g., 12 dB/second).

In addition, each of the estimates generated in process 76 (envelope estimate $\hat{A}_p(k)$), and process 78 (noisy speech signal power estimate $\hat{P}_{x,p}(k)$, and noise power estimate $\hat{P}_{n,p}(k)$), are stored by DSP 30 in its memory, in process 81. These estimates will then be available for use in processes 76, 78 for the next set of transform coefficients $X_p(k+1)$ corresponding to the next set of sample input values for the noisy speech signal.

In process 80, DSP 30 next generates a gain filter operator $G_p(k)$ for each sub-band p, based upon the noise and noisy speech signal power estimates. According to the preferred embodiment of the invention, gain filter operator $G_p(k)$ for the pth sub-band is derived according to the following relationship:

$$G_p(k) = \max\left(G_{\min}, \left(1.0 - \eta\frac{\hat{P}_{n,p}(k)}{\hat{P}_{x,p}(k)}\right)^{\frac{1}{2}}\right)$$

The value $G_{min}$ is a minimum value of gain that is selected to prevent the domination of the gain by very low gain values that may result from non-speech low-noise intervals. While lower levels of $G_{min}$ may provide improved noise suppression, some speech distortion may result with extremely low minimum gains. According to an implemented version of the preferred embodiment of the invention, by way of example, the value $G_{min}$ was selected so as to be on the order of 10 dB, with good results. As described in the above-incorporated U.S. application Ser. No. 08/426,746, this clamping of the gain prevents random fluctuations in the filtered signal. Secondly, also as described in the above-incorporated U.S. application Ser. No. 08/426,746, the scalar factor η is selected so as to slightly increase the noise power spectrum estimate $\hat{P}_{n,p}(k)$, for example by 5 dB, so that small errors in the sub-band estimates of noise power $\hat{P}_{n,p}(k)$ do not result in fluctuating attenuation filters.

These two factors greatly reduce the amplitude of musical noise as may otherwise be generated, as described in the above-incorporated U.S. application Ser. No. 08/426,746. Process 80 is performed for each of the p sub-bands, thus generating a set of gain filter operators $G_p(k)$ which are temporarily stored in memory of DSP 30.

In process 82, DSP 30 applies the gain filter operators $G_p(k)$ to modify each of the transform coefficients $X_p(k)$, applying noise suppression according to the smoothed spectral subtraction technique. Process 82 is performed sub-band by sub-band, by simple multiplication, as follows:

$$\hat{S}_p(k)=G_p(k)X_p(k)$$

The modified coefficients $\hat{S}_p(k)$ represent the filtered transform domain coefficients, arranged according to the p sub-bands for the critical bands of the human ear, and filtered so as to greatly reduce the noise in the signal. Process 52 is now complete for this set of coefficients $X_p(k)$.

Referring back to FIG. 2, process 54 is next performed by DSP 30, to generate time-domain sample output values $x_f(k)$ corresponding to the filtered speech signal. Process 54 is performed simply by applying the inverse transform of process 50. As described in Malvar, "Extended Lapped Transforms: Properties, Applications, and Fast Algorithms," *IEEE Transactions on Signal Processing*, Vol. 40, No. 11 (November 1992) pp. 2703– 2714, the inverse transform is readily performable by reversing the application of the DCT matrix factor and butterfly matrix factors, followed by resequencing of the output values. Of course, this inverse transform must be performed in a hierarchical manner corresponding to the hierarchical manner of process 50 as described above relative to FIGS. 4 and 6, to generate the time-domain sample stream $x_f(k)$, for storage, transmission, or output as appropriate for the particular application.

In the system of FIG. 1, the output filtered time-domain sample stream $x_f(k)$ is applied by DSP 30 to RF circuitry 40. RF codec 32 encodes the sample stream $x_f(k)$ according to the appropriate coding used by handset 10. The encoded sample stream is modulated by modulator 34, and amplified and driven by driver 36 for transmission to the cellular system via antenna A, in the conventional manner.

By way of example, the noise suppression method according to the preferred embodiment of the invention has been observed to be especially advantageous in suppressing noise in low-cost applications, such as cellular telephone handsets. Firstly, the number of numerical computations (additions and multiplications) required by the preferred embodiment of the invention is much reduced from conventional techniques, permitting use of the present invention in relatively modest performance systems with little delay. For example, an implementation of the present invention has been observed to require less than half of the number of additions and multiplications, and about one-half of the number of instructions per second (MIPS), as compared with advanced FFT techniques. Secondly, the memory requirements of the digital signal processor implementing the preferred embodiment of the invention has been observed to be much reduced, for example on the order of one-third the memory requirement of conventional FFT techniques. Specifically, implementation of the preferred embodiment of the invention in conventional digital signal processing circuitry has been accomplished with requiring only on the order of 1.8 MIPS performance, 300 words of random access memory, and 1k words of read-only memory, to accomplish real-time processing.

In addition, as noted above, the dynamic range of the transform performed in connection with the preferred embodiment of the invention has been observed to be greatly reduced from that of conventional FFTs. For example, the sub-band coefficients derived according to the preferred embodiment of the invention, for typical human speech, have been observed to have a dynamic range of less than one-tenth the range of 256 point FFT coefficients, and less than one-half that of 32-point FFT coefficients, as generated according to modem FFT techniques. As a result, the present invention may be readily implemented in fixed point digital signal processors, and thus using relatively low-cost circuitry (as opposed to floating-point DSPs), while providing high quality output.

Furthermore, the preferred embodiment of the invention has been observed to be relatively free from "musical" noise that is often generated by conventional FFT-based noise suppression systems using spectral subtraction. Decomposition of the signal according to the critical sub-bands of the human ear, in an implemented example of the preferred embodiment of the present invention, has been observed to provide high quality speech output, in subjective tests.

According to the preferred embodiment of the invention, therefore, the preferred embodiment of the invention provides a method and system by way of which noise may be greatly eliminated from a speech signal, without generation of musical noise, in a single-microphone environment. The reduced dynamic range and low computational complexity provided by the present invention permit the use of relatively modest performance fixed-point digital signal processors. It is therefore contemplated that the present invention will be especially beneficial in low-cost applications such as digital cellular telephone handsets and the like.

While the present invention has been described according to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

I claim:

1. A method of processing signals representative of human-audible information to suppress additive audible noise therein, comprising the steps of:

sampling a voice signal at a sampling frequency to produce a series of sampled amplitudes;

converting the sampled amplitudes into a digital form; and selecting a contiguous group of converted sampled amplitudes as an input sequence of digital signals;

applying a transform to a time-domain input sequences of digital signals to produce a plurality of transform coefficients, each transform coefficient corresponding to one of a plurality of frequency sub-bands, the plurality of frequency sub-bands having non-uniform bandwidths similar to critical bands of the human ear;

generating a plurality of filter operators, each associated with one of the plurality of sub-bands;

modifying each of the plurality of transform coefficients with a corresponding one of the plurality of filter operators;

applying an inverse transform to the modified transform coefficients to produce a time-domain output sequence of digital signals; and repeating the applying, generating, modifying, and applying steps for subsequent input sequences of digital signals.

2. The method of claim 1, wherein the transform applied in the applying step is a hierarchical lapped transform.

3. The method of claim 2, wherein the step of applying a transform comprises:

applying a first extended lapped transform to the input sequence to generate a first plurality of result coefficients, each result coefficient corresponding to one of a plurality of frequency bands;

selecting at least one low-frequency result coefficient from the first plurality of result coefficients;

applying a second extended lapped transform to the selected at least one low-frequency result coefficient to generate a second plurality of result coefficients;

storing, in memory, the second plurality of result coefficients as corresponding ones of the plurality of transform coefficients;

selecting at least one high-frequency result coefficient from the first plurality of result coefficients; and storing, in memory, the selected at least one high-frequency result as corresponding ones of the plurality of transform coefficients.

4. The method of claim 3, wherein the step of selecting at least one low-frequency result coefficient selects multiple ones of the low-frequency result coefficients from the first plurality of result coefficients.

5. The method of claim 3, wherein the step of applying a transform further comprises:

after the step of applying a first extended lapped transform, selecting at least one mid-frequency result coefficient from the first plurality of result coefficients;

applying a third extended lapped transform to the selected at least one mid-frequency result coefficient to generate a third plurality of result coefficients; and storing, in memory, the third plurality of result coefficients as corresponding ones of the plurality of transform coefficients.

6. The method of claim 5, wherein the step of selecting at least one mid-frequency result coefficient selects multiple ones of the mid-frequency result coefficients from each of the first plurality of groups of result coefficients.

7. The method of claim 5, wherein the method is performed by a digital signal processor;

wherein the step of applying a first extended lapped transform comprises operating the digital signal processor to perform a sequence of butterfly and discrete cosine transform operations upon the input sequence to produce the first plurality of result coefficients;

wherein the step of applying a second extended lapped transform to the selected at least one low-frequency result coefficient comprises operating the digital signal processor to perform a sequence of butterfly and discrete cosine transform operations upon the selected at least one low-frequency result coefficient to produce the second plurality of result coefficients;

and wherein the step of applying a third extended lapped transform to the selected at least one mid-frequency result coefficient comprises operating the digital signal processor to perform a sequence of butterfly and discrete cosine transform operations upon the selected at least one mid-frequency result coefficient to produce the third plurality of result coefficients.

8. The method of claim 1, wherein the generating step comprises, for each of the plurality of transform coefficients:

estimating an input signal power value based upon the transform coefficient;

estimating a noise power value based upon the transform coefficient and upon a previously estimated noise power value;

generating a filter operator corresponding to a ratio of the estimated noise power value to the estimated input signal power value.

9. The method of claim 8, wherein the step of estimating a signal power value comprises, for each of the plurality of transform coefficients:

determining a current envelope estimate from the larger of the magnitude of the transform coefficient and a previous envelope estimate multiplied by a decay factor;

applying a low-pass filter operator to the current envelope estimate and a previous signal power estimate, to produce a current signal power estimate; and storing the current signal power estimate for use as the previous signal power estimate for a subsequent input sequence.

10. The method of claim 8, wherein the step of estimating a noise power value comprises, for each of the plurality of transform coefficients:

determining a current envelope estimate from the larger of the magnitude of the transform coefficient and a previous envelope estimate multiplied by a decay factor;

applying a low-pass filter operator to the current envelope estimate and a previous noise power estimate, to produce a current noise power estimate;

clamping the current noise power estimate so as not to decrease from the previous noise power estimate by more than a first clamp rate, and so as not to increase from the previous envelope estimate by more than a second clamp rate that is less than the first clamp rate; and storing the clamped current noise power estimate for use as the previous noise power estimate for a subsequent input sequence.

11. A communications device, comprising:

an input device for receiving audio information;

circuitry, coupled to the input device, for converting the received audio information into time-domain input sequences of digital values;

a digital signal processor, programmed to perform, for each input sequence, a plurality of operations comprising:

applying a transform to the input sequence to produce a plurality of transform coefficients, each transform coefficient corresponding to one of a plurality of frequency sub-bands, the plurality of frequency sub-bands having non-uniform bandwidths similar to critical bands of the human ear;

generating a plurality of filter operators, each associated with one of the plurality of sub-bands;

modifying each of the plurality of transform coefficients with a corresponding one of the plurality of filter operators; and applying an inverse transform to the modified transform coefficients to produce a time-domain output sequence of digital signals; and an output subsystem, for communicating the output sequences.

12. The communications device of claim 11, wherein the input device comprises a microphone.

13. The communications device of claim 12, wherein the input device comprises a single microphone.

14. The communications device of claim 12, wherein the converting circuitry comprises an analog-to-digital converter.

15. The communications device of claim 12, wherein the output subsystem comprises:

radio frequency circuitry for receiving the output sequences and producing modulated signals corresponding thereto; and an antenna, driven by the radio frequency circuitry.

16. The communications device of claim 11, wherein the operation of applying a transform comprises:

applying a first extended lapped transform to each input sequence to generate a first plurality of result coefficients, each result coefficient corresponding to one of a plurality of frequency bands;

selecting at least one low-frequency result coefficient from the first plurality of result coefficients;

applying a second extended lapped transform to the selected at least one low-frequency result coefficient to generate a second plurality of result coefficients;

storing, in memory, the second plurality of result coefficients as corresponding ones of the plurality of transform coefficients;

selecting at least one mid-frequency result coefficient from the first plurality of result coefficients;

applying a third extended lapped transform to the selected at least one mid-frequency result coefficient to generate a third plurality of result coefficients;

storing, in memory, the third plurality of result coefficients as corresponding ones of the plurality of transform coefficients;

selecting at least one high-frequency result coefficient from the first plurality of result coefficients; and storing, in memory, the selected at least one high-frequency result as corresponding ones of the plurality of transform coefficients.

17. The communications device of claim 16, wherein the operation of selecting at least one low-frequency result coefficient selects multiple ones of the low-frequency result coefficients from the first plurality of result coefficients.

18. The communications device of claim 11, wherein the operation of applying a first extended lapped transform comprises operating the digital signal processor to perform a sequence of butterfly and discrete cosine transform operations upon the input sequence to produce the first plurality of groups of result coefficients;

wherein the operation of applying a second extended lapped transform to the selected at least one low-frequency result coefficient comprises operating the digital signal processor to perform a sequence of butterfly and discrete cosine transform operations upon the selected at least one low-frequency result coefficient to produce the second plurality of result coefficients;

and wherein the operation of applying a third extended lapped transform to the selected at least one mid-frequency result coefficient comprises operating the digital signal processor to perform a sequence of butterfly and discrete cosine transform operations upon the selected at least one mid-frequency result coefficient to produce the third plurality of result coefficients.

19. The communications device of claim 11, wherein the generating operation comprises, for each of the plurality of transform coefficients:

estimating an input signal power value based upon the transform coefficient;

estimating a noise power value based upon the transform coefficient and upon a previously estimated noise power value;

generating a filter operator corresponding to a ratio of the estimated noise power value to the estimated input signal power value.

20. The communications device of claim 19, wherein the operation of estimating a signal power value comprises, for each of the plurality of transform coefficients:

determining a current envelope estimate from the larger of the magnitude of the transform coefficient and a previous envelope estimate multiplied by a decay factor;

applying a low-pass filter operator to the current envelope estimate and a previous signal power estimate, to produce a current signal power estimate; and storing the current signal power estimate for use as the previous signal power estimate for a subsequent input sequence.

21. The communications device of claim 19, wherein the operation of estimating a noise power value comprises, for each of the plurality of transform coefficients:

determining a current envelope estimate from the larger of the magnitude of the transform coefficient and a previous envelope estimate multiplied by a decay factor;

applying a low-pass filter operator to the current envelope estimate and a previous noise power estimate, to produce a current noise power estimate;

clamping the current noise power estimate so as not to decrease from the previous noise power estimate by more than a first clamp rate, and so as not to increase from the previous envelope estimate by more than a second clamp rate that is less than the first clamp rate; and storing the clamped current noise power estimate for use as the previous noise power estimate for a subsequent input sequence.

22. A method of operating a telephonic apparatus to suppress acoustic noise in an input speech signal that includes additive noise comprising:

applying a hierarchical lapped transform to sampled incoming signal to decompose the input signal into coefficients representative of frequency sub-bands of non-uniform bandwidth corresponding to critical bands of the human ear;

for each coefficient, modifying by application of a gain filter operator derived from a ratio of an estimate of the noise power in the sub-band to an estimate of the noisy signal power in the same sub-band calculated using the larger of the input signal amplitude or a decayed amplitude from a prior time interval; and inverse transforming of the modified coefficient to provide the filtered time-domain output signal.

* * * * *